United States Patent [19]

Tschui et al.

[11] 3,987,701

[45] Oct. 26, 1976

[54] AMMUNITION CONVEYOR CHANNEL FOR AN AUTOMATIC FIRING WEAPON

[75] Inventors: Fredy Tschui; Ernst Hürlemann, both of Zurich; Jürg Zellweger, Neerach, all of Switzerland

[73] Assignee: Werkzeugmaschinenfabrik Oerlikon-Buhrle AG, Zurich, Switzerland

[22] Filed: May 9, 1975

[21] Appl. No.: 575,946

[30] Foreign Application Priority Data

May 16, 1974 Switzerland ..... 6706/74

[52] U.S. Cl. ..... 89/33 C; 89/33 SF

[51] Int. Cl.[2] ..... F41D 9/02

[58] Field of Search ..... 89/33 R, 33 BB, 33 C

[56] References Cited

UNITED STATES PATENTS 2,327,922 8/1943 Moore et al. ..... 89/33 C

FOREIGN PATENTS OR APPLICATIONS 1,231,602 9/1960 France ..... 89/33 C

*Primary Examiner*—Stephen C. Bentley

*Attorney, Agent, or Firm*—Werner W. Kleeman

[57] ABSTRACT

An ammunition conveyor channel for use with an automatic firing weapon and through which channel there can be conveyed belted ammunition to the weapon, comprising an inlet opening through which there can be introduced the ammunition into the ammunition conveyor channel, a first outlet opening through which there can be ejected the ammunition and inserted into the weapon barrel, and a second outlet opening through which there can be ejected the belt elements of the ammunition belt out of the ammunition conveyor channel. The second outlet opening is arranged in a cover member extending transversely with respect to the conveying direction of the ammunition, this cover member being mounted to be pivotable about a pivot shaft arranged externally of the cross-sectional area of the channel so as to be pivoted into an open position enabling removal of the ammunition introduced through the inlet opening and not ejected through the first outlet opening.

1 Claim, 5 Drawing Figures

AMMUNITION CONVEYOR CHANNEL FOR AN AUTOMATIC FIRING WEAPON

BACKGROUND OF THE INVENTION

The present invention relates to a new and improved construction of ammunition conveyor channel for use with an automatic firing weapon through which there can be delivered belted ammunition to such firing weapon, comprising an inlet opening through which there can be introduced the ammunition into the ammunition conveyor channel, a first outlet opening through which there can be ejected the ammunition and inserted into the weapon barrel, and a second outlet opening through which there can be ejected the belt elements of the ammunition belt out of the ammunition conveyor channel.

According to a state-of-the-art ammunition conveyor channel of this type this second outlet opening is so large that only the belt elements, after the disengagement of the ammunition, can pass through such second outlet opening but not the ammunition itself. In the event that ammunition which is still in the conveyor channel and not yet been fired again must be removed then it is necessary to withdraw the ammunition through the aforementioned inlet opening. However, at this inlet opening there is oftentimes connected a flexible channel composed of individual channel elements. When the ammunition must be retracted through such flexible channel the danger exists that the belt elements will become entangled with or snared at the channel elements and then only can be released with considerable effort.

SUMMARY OF THE INVENTION

Hence, it is a primary object of the present invention to provide a new and improved construction of ammunition conveyor channel for an automatic firing weapon which is not associated with the aforementioned drawbacks and limitations of the prior art proposals discussed above.

Another and more specific object of the present invention aims at the provision of an ammunition channel wherein the ammunition which has not been fired need not be retracted through the aforementioned inlet opening, rather can be effortlessly removed out of the conveyor channel in the ammunition conveying direction.

Now in order to implement these and still further objects of the invention, which will become more readily apparent as the description proceeds, the ammunition conveyor channel of this development is manifested by the features that the second outlet opening is located in a cover member which is arranged transversely with respect to the ammunition conveying direction, this cover member can be tilted or pivoted open about a pivot axis arranged externally of the cross-section or cross-sectional area of the channel for the purpose of removing ammunition delivered through the inlet opening and which has not been ejected through the first outlet opening.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 5:
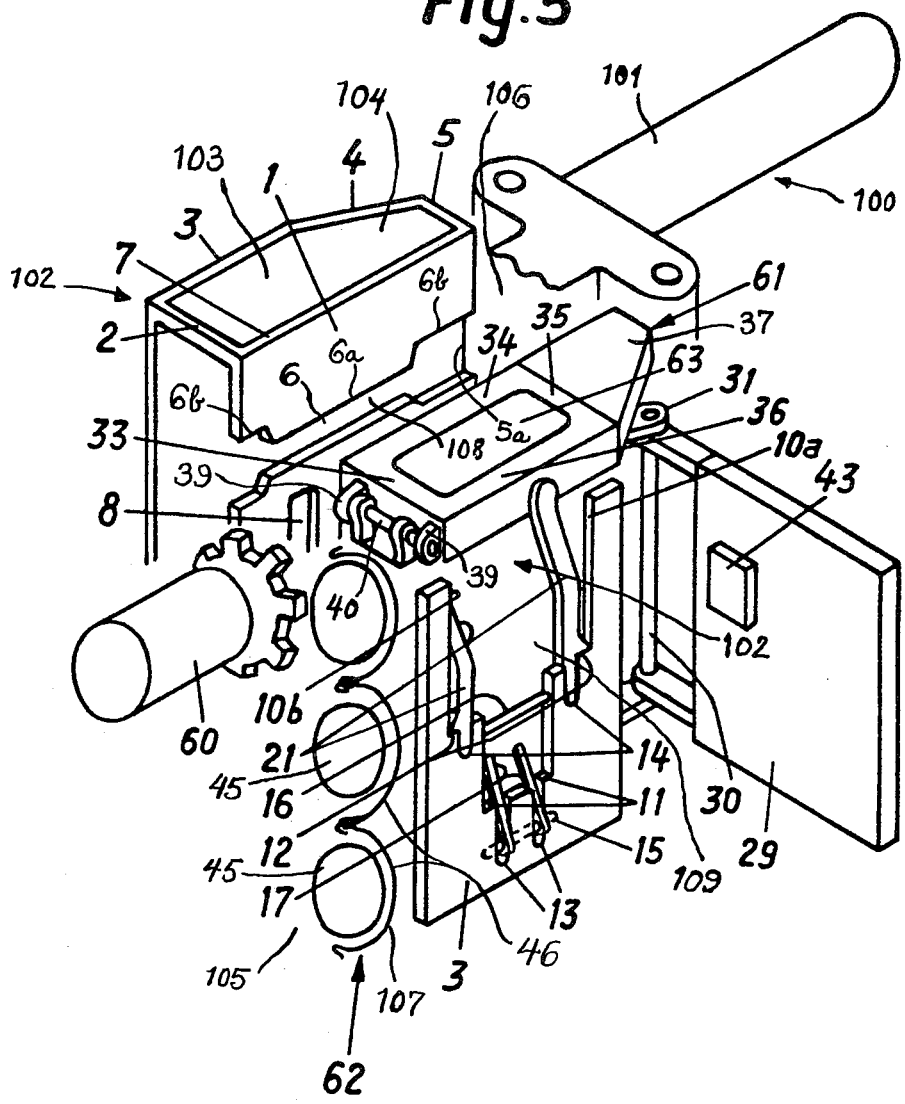
FIG. 5 illustrates in perspective view details of the ammunition conveyor channel according to FIGS. 1 to 4, portraying an arrangement of two such conveyor channels, and showing some of the parts of a firing weapon.

Describing the invention now in greater detail, it is first of all to be understood that only enough of the automatic firing weapon has been shown to enable those skilled in the art to readily understand the underlying concepts of the invention, and equally only enough of the structure of the ammunition conveyor channel for such firing weapon has been portrayed as concerns the novel concepts of this development. Other details of such ammunition conveyor channel constitutes subject matter of the commonly assigned, copending U.S. application Ser. No. 575,952, filed May 9, 1975, entitled "Cartridge Infeed Apparatus For An Automatic Firing Weapon," listing as the inventor Jurg Zellweger, one of the co-inventors herein, to which reference may be readily had and the disclosure of which is incorporated herein by reference. Furthermore, it is to be appreciated that in the showing of FIG. 5 there is illustrated an automatic firing weapon, which has been schematically shown and generally indicated by reference character 100, having a weapon barrel 101, wherein there is provided for such firing weapon 100 two ammunition conveyor channels 102 of this development, one of which has been shown at the left-hand side of the weapon barrel 101 and the other of which is shown positioned at the right-hand side of such weapon barrel 101. These ammunition conveyor channels 102 are essentially identical in construction, so that it will be sufficient to describe only one of them, and for purposes of clarity in illustration it will be recognized the ammunition conveyor channel 102 at the right-hand side of the weapon barrel 101 has certain of the channel walls removed to better reveal the internal structure thereof and to provide a better understanding of the description thereof. It is to be further understood that it is not absolutely necessary to always provide a twin-arrangement of ammunition conveyor channels 102 for the automatic firing weapon 100 and it would be possible to use one such automatic conveyor channel; however the use of the twin-arrangement as depicted in FIG. 5 permits, by way of example, one ammunition conveyor channel to contain one type of ammunition and the other another type of ammunition, so that the ammunition infeed operation can be selectively switched from one to the other ammunition conveyor channel to enable firing a given type of ordnance, depending upon the encountered target. This obviously has advantages in allowing the gunner to easily switch from one type of ammunition to another in a most convenient and rapid fashion for beneficial accommodation of the ammunition to be fired to the nature of the target intended to be destroyed.

Figure 1:
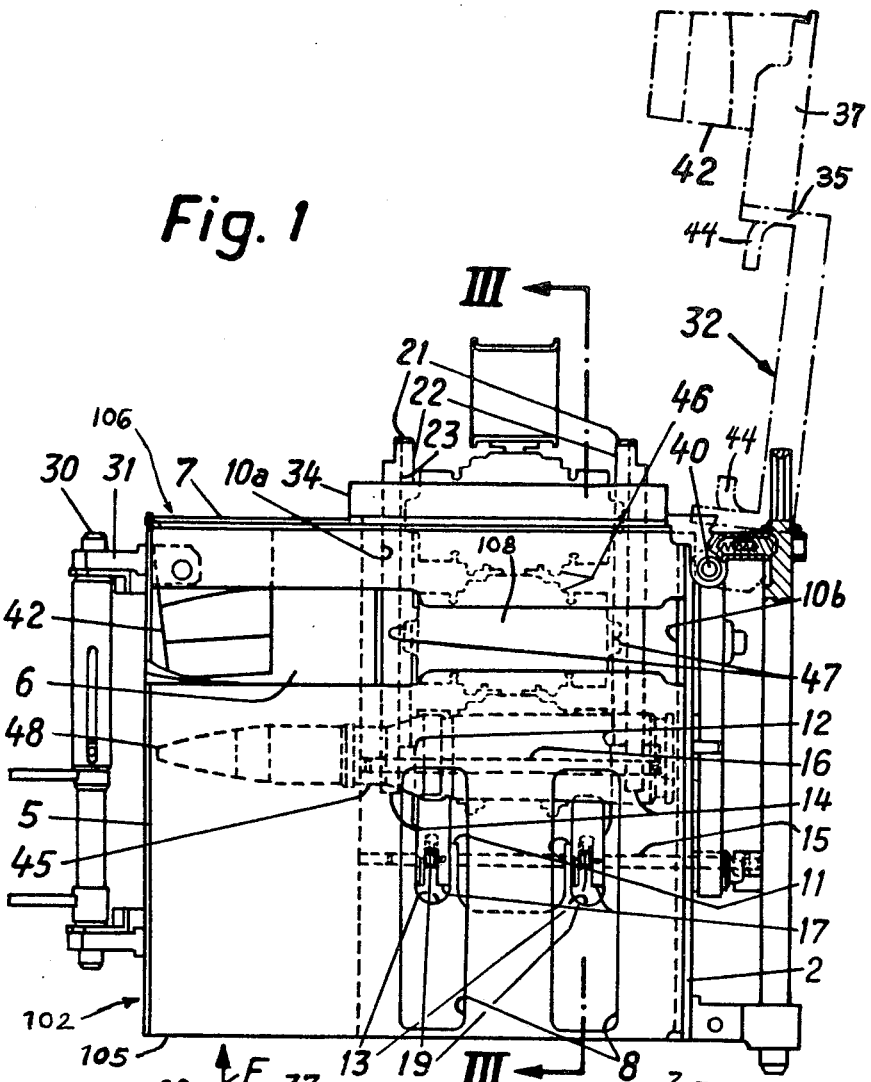
FIG. 1 is a side elevational view of a conveyor channel for an ammunition belt and designed according to the teachings of the present invention.
Figure 2:
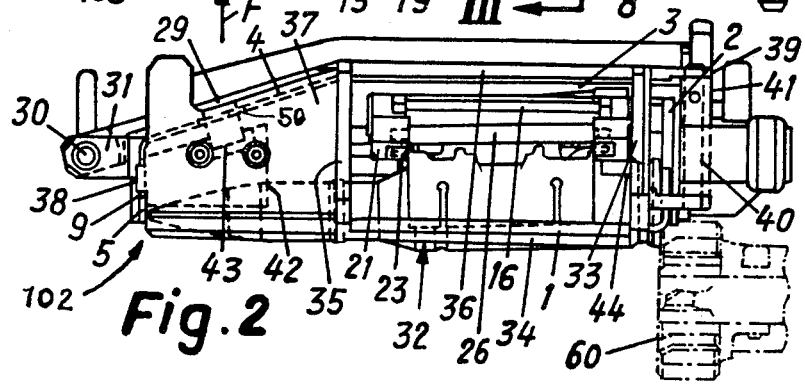
FIG. 2 is a bottom view of the conveyor channel looking in the direction of the arrow F of FIG. 1.

Now with the foregoing in mind, and describing the drawings in greater detail, according to the showing of FIGS. 1, 2 and 5 side walls 1, 2, 3, 4, and 5 form an ammunition conveying or conveyor channel, as best recognized for the conveyor channel 102 appearing at the left-hand side of the weapon barrel 101 of FIG. 5, wherein the cross-section of such conveyor channel is constituted by a rectangular portion of rectangle 103 and a therewith merging trapezoid or trapezoidal portion 104. It will be seen that the rectangular portion 103 is bounded by part of the side wall 1 and the further conveyor channel walls 2 and 3 and the trapezoid portion 104 by a further part or portion of the side wall 1 and the channel walls 4 and 5. Side wall 1 is located at a not particularly illustrated breechblock housing of the firing weapon 100 and possesses a substantially rectangular slot 6 (FIGs. 1 and 5) arranged and extending substantially transversely with respect to the direction of conveying of the ammunition through the ammunition conveyor channel 102. The ammunition is conveyed from the lower end 105 of the ammunition conveyor channel 102 (considering now the channel at the right-hand side of the weapon barrel 101 through an ammunition inlet opening 62 (FIG. 2) towards the upper end 106 thereof, as best recognized by referring to FIGS. 1 and 5. Into this slot 6 there extends a breechblock 60 of the firing weapon 100 and which breechblock 60 is displaceable in the aforementioned breechblock housing, breechblock 60 being shown particularly well in FIGS. 2 and 5.

The ammunition conveyor channel 103 under discussion possesses at its lower end 105 the aforementioned inlet opening 62 through which the belted ammunition, generally indicated by reference character 107, arrives in conveyor channel 102. Further, this ammunition conveyor channel 102 is provided at its upper end 106 with an outlet opening 63 through which there can be ejected the belt elements 46 out of the associated ammunition conveyor channel 102. This outlet opening 63 as will be explained more fully hereinafter, is of a size such that there can only pass therethrough the belt elements 46, but not the actual ammunition, i.e. the cartridges 45. The slot 6 in the side wall 1 has an intermediate portion 6a at each end of which there merges an enlarged stepped slotted portion 6b. This slot 6 in the side wall 1 together with a slot 5a (FIG. 5) provided in the end wall 5 forms an outlet opening 108 through which there can be displaced the cartridges 45 into the weapon barrel 101 by means of the breechblock 60.

According to the showing of FIGS. 1 and 5 the wall 3 which is parallel to the wall 1 possesses a large opening 109 which is bounded by two vertically extending edges 10a and 10b as well as two smaller grooves 14 and two larger grooves 13 which terminate at two horizontal edges 11 and 12. At the channel wall 3 there are secured two shafts or axles 15 and 16 which are essentially parallel to such channel wall 3. Upon the shaft or axle 16 there are pivotably mounted the ends of two pawls or pawl members 17. These pawls 17 extend, on the one hand, into the grooves 13 of the channel wall 3 and, on the other hand, extend at an inclination upwardly into the conveyor channel 102. Pivotably mounted at the shaft or axle 16 are the ends of two guide arms 21. These guide arms 21 extend, on the one hand, into the grooves 14 of the channel wall 3 and, on the other hand, upwardly out of the channel 102. These guide arms 21 are bent or flexed and possess grooves 23 (FIGS. 1 to 4) which extend in the lengthwise direction of the guide arms and possess a substantially rectangular cross-sectional configuration.

Both of the guide arms 21 are connected with one another at their central portion by a rod 26 or the like. Secured to this rod 26 is one end 25 of a leg 24a of a blade or leaf spring 24 or equivalent structure, the other leg 28 of which bears against a cover or cover member 29. The leaf spring 24 is guided about the shaft or axle 16 and strives to press both of the guide arms 21 against the cartridges 45 located in the channel 102. The cover member 29 is pivotable about a shaft or axle 30. This shaft 30 is secured via supports or hinge bearings 31 at the channel wall 5.

Figure 3:
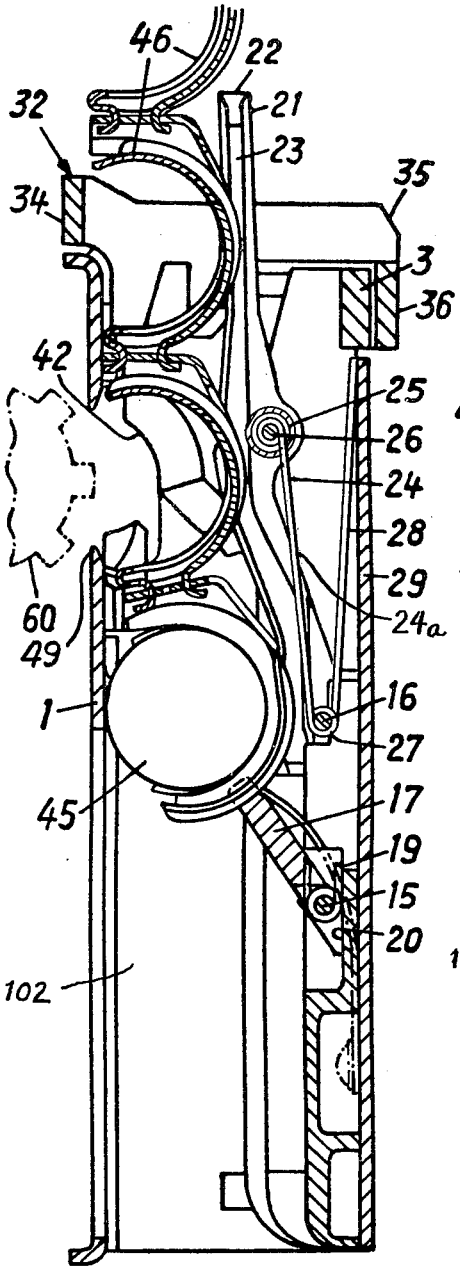
FIG. 3 is a cross-sectional taken substantially along the line III—III of FIG. 1.
Figure 4:
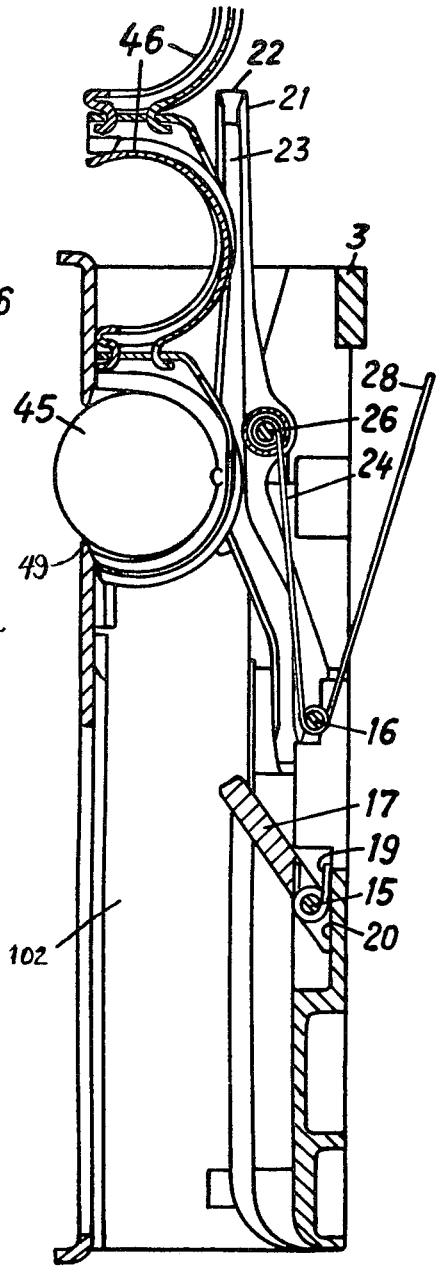
FIG. 4 illustrates the same sectional view as in FIG. 3, but this time with the cover member opened.

The conveyor channel 102 is closed at the top or upper end 106 by a cover or cover member 61. This cover 61 possesses a frame or frame means 32 embodying four walls 33, 34, 35, 36, wherein the wall 36 is downwardly extended relative to the walls 33, 34 and 35, as best seen in FIG. 3. Attached to the wall 35 of the frame 32 is a trapezoidal-shaped plate or plate member 37 disposed in a substantially horizontal plane which is essentially perpendicular to the channel walls and which possesses a nose member or nose 38. At the frame wall 33 there are secured two brackets 39 by means of which the frame or frame means 32 is pivotably mounted about a shaft or axle 40. This shaft 40 is connected through the agency of projection means 41 at the channel wall 2.

According to the showing of FIG. 2 the nose member 38 of the plate 37 of the frame or frame members 32 engages in a groove 9 of the channel wall 5 and thus the frame means 32 including its plate 37 is fixed in position. At the underside of the plate 37 there is attached a deflection member or element 42 and extends into the front upper portion of the channel 102. At the pivotal cover or cover member 29 there is attached a cam or dog 43 which extends through a slot 50 of the channel wall 4 into the deflection member 42. The top cover 61 is secured against unintentional opening thereof by means of this cam or dog 42 or equivalent means. Impact bodies 44 are attached to the frame walls 33, 35 (see FIG. 1).

According to the showing of FIG. 3, a belt section consisting of a cartridge 45 and three empty belt elements 46 is located in the channel 102 and partially externally thereof. The cartridge 45 engaged by a belt element 46 is raised by means of two not particularly illustrated conveyor pawls in the ammunition conveyor channel 102 into a position where it is prevented from falling back by means of the pawls 17. The belt elements 46 possess two flaps or tongues 47 (FIG. 1) which engage into the aforementioned grooves 23 of both guide arms 21. The guide arms 21 are subjected to the force of the blade or leaf spring 24 and thus bear at the impact or stop bodies 44. The belt section with the cartridges cannot be pulled upwardly in the conveying direction out of the channel since the projectile 48 of the cartridges 45 would impact against the deflection element or member 42 connected with the frame 32.

The mode of operation of the described apparatus is as follows: In order to remove the belt section out of the channel the cover member 29 is appropriately unlocked and pivoted about the shaft or axle 30. Due to the pivoting of the cover member 29 the cam or dog 43 connected therewith comes out of engagement with the deflection element 42 of the frame 32, so that the latter can be upwardly pivoted into the position illustrated in phantom lines in FIG. 1. In this position of the frame or frame means 32 the entire cross-section or cross-sectional area of the channel 102 has been laid freed or exposed towards the top. The blade or leaf spring 24 is no longer tensioned owing to the removal i.e. opening of the cover member 29, so that it does not exert any rotational moment upon the guide arms 21. Consequently, such guide arms 21 (considered with respect to the showing of FIG. 4) can be rocked in the clockwise direction about the shaft 16. When the cartridge 45 is located in the position of FIG. 4, then upon withdrawal of the belt section out of the channel 102 it is deflected against the interior of the channel by means of a force exerted upon such cartridge by the edge 49 of the channel wall 1 and thus the arms 21 are rocked about the shaft 16. The belt element with the cartridges 45 thus can be upwardly removed out of the channel 102 through the grooves 23 of the guide arms 21.

While there is shown and described present preferred embodiments of the invention, it is to be distinctly understood that the invention is not limited thereto, but may be otherwise variously embodied and practiced within the scope of the following claims.

Accordingly, what is claimed is:

1. An automatic firing weapon comprising:

a. a weapon barrel;

b. an ammunition conveyor channel through which belted ammunition can be delivered to the weapon;

c. said belted ammunition having i. belt elements, ii. ammunition carried thereby;

d. said ammunition conveyor channel having i. channel walls, ii. means defining an inlet opening through which there can be introduced the belted ammunition into the ammunition conveyor channel, iii. means defining a first outlet opening through which the ammunition can be ejected and introduced into the weapon barrel, iv. means defining a second outlet opening through which there can be ejected the belt elements out of the ammunition conveyor channel, v. a cover member arranged to extend substantially transversely with respect to the direction of conveying of the ammunition through the ammunition conveyor channel comprising 1. frame means formed of four walls, said frame means defining said second outlet opening, 2. means defining a pivot shaft for the cover member, 3. two brackets secured at one wall of the frame means and rotatably mounted at said pivot shaft, vi. said pivot shaft being connected at the outside of a wall of the conveyor channel and extending substantially transversely with respect to the lengthwise axis of the ammunition, the cover member can be pivoted about said pivot shaft into an open position for the removal of the ammunition delivered through the inlet opening and not ejected through the first outlet opening into the weapon barrel.

* * * * *